US007549463B1

(12) United States Patent
Schmeler et al.

(10) Patent No.: US 7,549,463 B1
(45) Date of Patent: Jun. 23, 2009

(54) COOLING PANEL FOR A FURNACE FOR PRODUCING IRON OR STEEL

(75) Inventors: Robert Schmeler, Dudelange (LU); Marc Solvi, Mess (LU); Roger Thill, Alzette (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/868,117

(22) PCT Filed: Nov. 12, 1999

(86) PCT No.: PCT/EP99/08735

§ 371 (c)(1),
(2), (4) Date: Aug. 20, 2001

(87) PCT Pub. No.: WO00/36154

PCT Pub. Date: Jun. 22, 2000

(30) Foreign Application Priority Data

Dec. 16, 1998 (LU) ..... 90328

(51) Int. Cl.
*F28F 3/12* (2006.01)

(52) U.S. Cl. ..... 165/168; 165/56; 165/178; 29/890.03

(58) Field of Classification Search ..... 165/53, 165/54, 168, 169, 178, 56; 29/890.03; 432/233, 432/238; 373/74, 76; 122/6 A; 285/141.1, 285/179.1; 266/46, 190, 193
See application file for complete search history.

(56) References Cited

U.S. PATENT DOCUMENTS 1,796,284 A * 3/1931 Davy ..... 122/6 R
2,911,235 A * 11/1959 Stumbough ..... 285/93
3,940,552 A * 2/1976 Mizuno ..... 373/76
4,097,679 A * 6/1978 Fukumoto et al. ..... 373/76
4,304,396 A * 12/1981 Udoh ..... 266/193
4,382,585 A * 5/1983 Fischer et al. ..... 266/190
4,453,253 A * 6/1984 Lauria et al. ..... 373/74
5,426,664 A 6/1995 Grove
5,678,806 A * 10/1997 Hille et al. ..... 266/193
5,904,893 A * 5/1999 Stein ..... 266/46
6,126,893 A 10/2000 Otsuka et al.

FOREIGN PATENT DOCUMENTS

| | | |
|---|---|---|
| DE | 29611704 U | 10/1996 |
| DE | 29715971 U | 11/1997 |
| GB | 2090952 | 7/1982 |
| GB | 2131137 | 6/1984 |
| JP | 60-28397 | 2/1985 |
| JP | 09-196274 A | 7/1997 |

* cited by examiner

*Primary Examiner*—Teresa J Walberg
(74) *Attorney, Agent, or Firm*—McCormick, Paulding & Huber LLP

(57) ABSTRACT

A cooling plate for an iron and steelmaking furnace includes a copper cooling plate body having at least one cooling duct for a cooling medium extending essentially parallel with the back of the cooling plate body. The cooling plate body further includes a preformed, externally accessible recess into which the cooling duct opens. A connection piece is utilized as a cooling medium connection on the back of the cooling plate body, while a formed piece fitted within the externally accessible recess forms a deflection surface for the cooling medium flowing from the connection piece into the cooling duct, or from the cooling duct into the connection piece.

24 Claims, 2 Drawing Sheets

Fig. 1
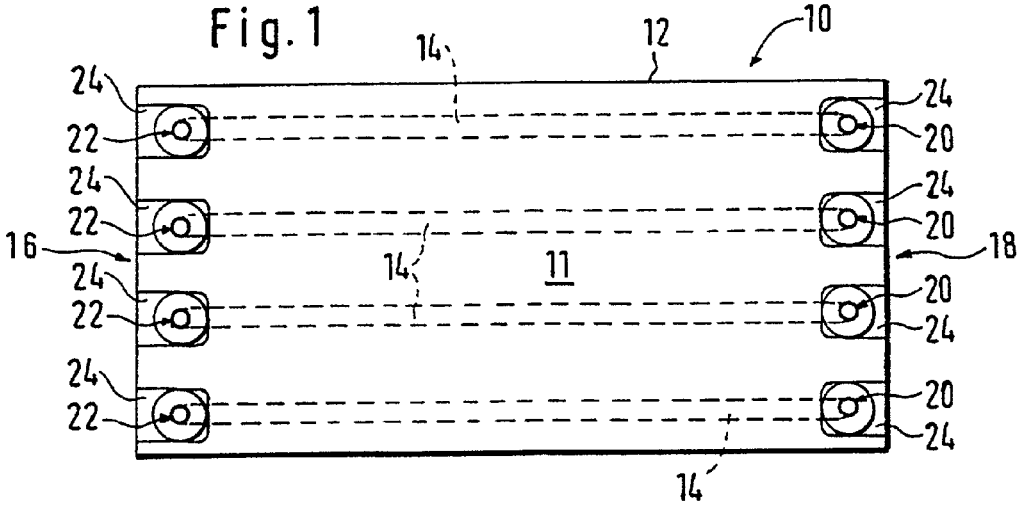
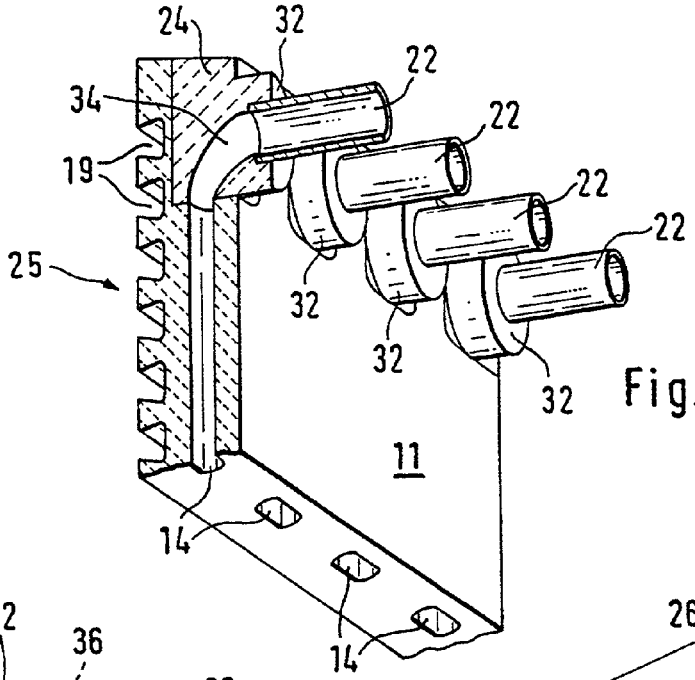
Fig. 2
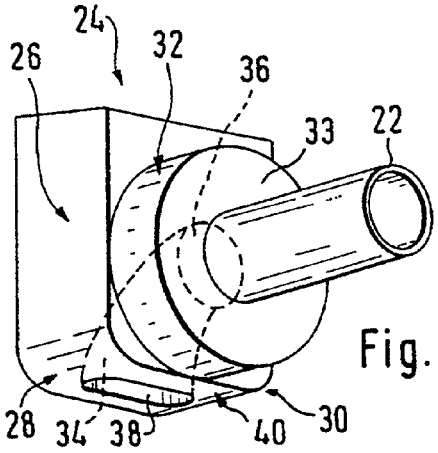
Fig. 3
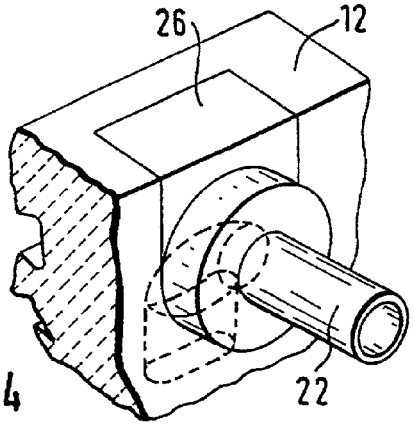
Fig. 4

COOLING PANEL FOR A FURNACE FOR PRODUCING IRON OR STEEL

FIELD OF THE INVENTION

The invention relates to a cooling plate for an iron- or steelmaking furnace.

BACKGROUND OF THE INVENTION

Such cooling plates are arranged on the inside of the furnace shell and have internal cooling ducts. These cooling plates are connected via connection pieces projecting from their back to a cooling system of the shaft furnace outside the furnace shell. Their surface facing the interior of the furnace is generally lined with a refractory material.

Most of these cooling plates are still made from cast iron. As copper has a far better thermal conductivity than cast iron, however, there is a current trend towards the use of cooling plates made from copper or copper alloys. Meanwhile several production methods have been proposed for copper cooling plates.

Initially an attempt was made to manufacture copper cooling plates by mould casting like cast iron cooling plates, the internal cooling ducts being formed by a sand core in the mould. This method has not proved effective in practice, however, because the cast copper plates exhibit cavities and porosity far more frequently than cast iron cooling plates. However, it is well known that such cavities and porosity have an extremely negative effect on the life and thermal conductivity of the plates.

It is already known from GB-A-1571789 how to replace the sand core by a preformed metallic pipe coil made from copper or high-grade steel in mould casting of the cooling plates. The pipe coil is integrally cast in the cooling plate body in the mould and forms a helical cooling duct. The two ends of the pipe coil project as connection pieces from the cooling plate body. This method has also not proved effective in practice. A high heat transmission resistance exists between the copper cooling plate body and the integrally cast pipe coil, so that relatively poor cooling of the plate results. Furthermore, cavities and porosity in the copper can likewise not be effectively prevented with this method.

Copper cooling plates for metallurgical furnaces are known from DE 29611704 U1, according to which prefabricated coolant ducts, consisting of copper pipe sockets, copper pipe lines and copper pipe bends are integrally cast in the cooling plate. The complete, prefabricated copper conduit is placed into the casting mould and the molten copper is poured around it. An improvement in heat transmission is expected for as a result of a partial fusing of the molten copper and the pipe wall. However, this process also fails to provide any protection from cavities and porosities in the cast copper plate.

A cooling plate made from a forged or rolled copper ingot is known from DE-A-2907511. The cooling ducts in this case are blind holes, which are introduced into the rolled copper ingot by mechanical deep drilling. The blind holes are sealed by soldering or welding in threaded plugs. Connecting holes to the blind holes are drilled from the back of the plate. Connection pieces for coolant feed or return are subsequently inserted in these connecting holes and soldered or welded in. Finally, pipe connection pieces with a larger diameter are welded or soldered as spacers coaxially with the connection pieces on the back of the plate.

The subsequently published WO 98/30345 describes a method in which a preform of the cooling plate is continuously cast. Inserts in the casting duct of the continuous casting mould produce ducts running in the continuous casting direction, which form straight cooling ducts in the finished cooling plate. The cross-section of these integrally cast ducts preferably has an oblong shape with its smallest dimension at right angles to the cooling duct. Consequently cooling plates with a smaller plate thickness than cooling plates with drilled ducts can be manufactured. Copper is thus saved and the useful volume of the furnace increased. A further advantage of the oblong cross-section is that larger exchange areas on the coolant side can be achieved in the cooling plate. A plate is cut out of the continuously cast preform by two cuts at right angles to the casting direction, two end faces with a spacing corresponding to the required length of the cooling plate being formed. In the next production step connecting holes terminating in the ducts are drilled into the plate at right angles to the rear surface and the end terminations of the ducts closed. Connection pieces are subsequently inserted in the connection holes, as already described above.

The methods described in DE-A-2907511 and WO98/30345 both permit production of high-grade cooling plate bodies from copper or copper alloys, the method described in WO98/30345 being characterised by particularly low production costs. However, a disadvantage of the finished cooling plates of both methods compared to cooling plates with integrally cast pipe coils or mould-cast plates is that they exhibit a relatively high pressure loss in the area of the transitions from the connection pieces to the cooling ducts. This applies in particular, but not exclusively, if the cooling ducts have an oblong cross-section, as described in WO98/30345.

For the sake of completeness it should also be mentioned that a cast-iron cooling plate with integrally cast cooling pipes, which has an oval cross-section in its straight section, but a circular cross-section at the inlet and outlet, is described in EP-A-0144578.

SUMMARY OF THE INVENTION

The invention is based on the task of creating a transition ensuring relatively favourable flow from the connection pieces to the cooling ducts without the need to revert to mould-cast cooling plate bodies or cooling plate bodies with integrally cast cooling pipes with their above-mentioned disadvantages. This problem is solved by a cooling plate in accordance with the present invention.

The cooling plate according to the invention comprises a copper cooling plate body (i.e. a cooling plate body made from copper or a copper alloy), with at least one cooling duct, which extends essentially parallel with the back of the cooling plate. At least one connection piece is arranged on the back of the cooling plate body and terminates in the cooling plate body in the at least one cooling duct. According to the invention the cooling plate has an insert a formed piece, which is inserted fitted in a prefabricated, externally accessible recess in the cooling plate body and forms a deflection surface for the cooling medium in the area of the termination of the connection piece in the cooling duct. The entry of the cooling medium from the connection piece into the cooling duct or from the cooling duct into the connection piece can be improved from the flow point of view in an extremely simple way by this deflection surface. Consequently the pressure losses in the cooling plate can be substantially reduced, which of course has a favourable effect on the energy consumption for circulation of the cooling medium. The risk of steam bubble formation by high local pressure losses is likewise greatly reduced. Furthermore, escape of the air during filling of the cooling plates with the cooling medium is simplified by the deflection surface according to the invention. In other words the deflection surfaces according to the invention prevent air pockets from forming in the cooling ducts and causing so-called "hot spots". It should also be noted that the invention can be applied to cooling plate bodies which are manufactured by the methods described in DE-A-2907511 and in WO98/30345, with excellent results with regard to reduction of the pressure losses. Consequently these cooling plate bodies can also be used, if low pressure losses are required, which was so far not possible.

In an extremely simple embodiment of the invention, the formed piece is arranged in an axial extension of the cooling duct, the deflection surface being formed by one of its end faces. If the cooling duct is formed, for example, by a duct which has an opening in an end face of the cooling plate body, the insert formed piece is advantageously a plug, which is inserted in this opening and extends into the cooling duct as far as the opening of the connection piece, where it forms the deflection surface for the cooling medium. To improve the transition between the connection piece and the cooling duct from the flow point of view, it is already sufficient that the deflection surface is formed by a bevelled end of the formed piece. Deflection surfaces optimised from the flow point of view with a concave curvature naturally permit further reduction of the local pressure loss.

The formed piece may also be a prefabricated transition piece, e.g. a copper mould casting, which is inserted sealed from the outside in a suitably adapted recess in the cooling plate body, into which the cooling duct forms an opening. This transition piece has a curved internal transition duct, which forms a first and second opening in the transition piece. The first opening terminates in the connection piece in this case. By contrast the second opening in the cooling plate body is opposite the opening of the cooling duct. The curved transition duct, which may be integrally cast in a mould casting, for example, forms a transition substantially more favourable from the flow point of view from the connection piece to the cooling duct than a pipe connection welded or soldered directly into a hole in the cooling plate body.

These cooling plates with inserted transition pieces likewise have the advantage that the transition between the connection piece and the cooling duct is always formed identically by a standardised prefabricated transition piece, so that the pressure losses in the individual cooling circuits can be predetermined and coordinated far more easily. The transition pieces are also preferable from the mechanical point of view to direct welding or soldering in of a connection piece into a hole in the cooling plate body.

Reduction of the pressure loss by the transition piece according to the invention is particularly pronounced for cooling plate bodies with cooling ducts which have an oblong cross-section. In these cooling plates the transition from the oblong cross-section of the cooling duct to a circular cross-section in the coolant connection is in fact effected progressively in the curved transition duct of the transition piece, so that discontinuities in the flow pattern are avoided.

The transition piece advantageously has a solid shoulder, which forms a spacer which projects from the back of the cooling plate. In the assembled cooling plate these shoulders simultaneously press a seal into the bushing of the connection pieces in the furnace shell. It is thus unnecessary to weld or solder an additional element around the connection piece to the back of the cooling plate, so that the cooling plate production process is simplified. Furthermore, a relatively solid shoulder on the transition piece facilitates assembly of the connection piece.

The recess for the transition piece is advantageously cut into the copper cooling plate body from the rear, the depth of the recess being smaller than the thickness of the cooling plate body. With this embodiment the front side of the cooling plate facing the furnace interior remains intact.

The recess for the transition piece advantageously terminates in one end of the cooling plate body. Consequently it can be manufactured more easily and the cooling duct can extend to a point immediately adjacent to the end of the cooling plate body. Furthermore, it should be noted in relation to this embodiment of the invention that the transition piece closes and seals the cooling duct at the end. Consequently the soldering or welding of plugs into the cooling ducts open at the ends described in DE-A-2907511 and WO98/30345 is dispensed with, so that a further operating step is saved.

In a first embodiment the cooling plate body is a forged or rolled copper ingot as described in DE-A-2907511, the cooling ducts being produced as blind holes by mechanical deep drilling.

In a preferred embodiment the copper cooling plate body is continuously cast as described in WO98/30345, however, the cooling ducts being produced as through ducts in the casting direction during continuous casting.

Production of such a cooling plate is particularly simple, but it still has far better mechanical and thermal properties than a cast copper cooling plate.

BRIEF DESCRIPTION OF THE DRAWINGS

For better illustration of the invention and its advantages, an exemplified embodiment will be described in more detail with the aid of the enclosed drawings.

FIG. 1 shows a plan view of the rear of a cooling plate according to the invention;

FIG. 2 a perspective section of the cooling plate in FIG. 1;

FIG. 3 a perspective detailed view of a transition piece with connection piece;

FIG. 4 a perspective detailed view of the transition piece in FIG. 3 inserted in an end recess in a cooling plate body;

DETAILED DESCRIPTION OF THE PREFERRED EMBODIMENT

Figure 5:
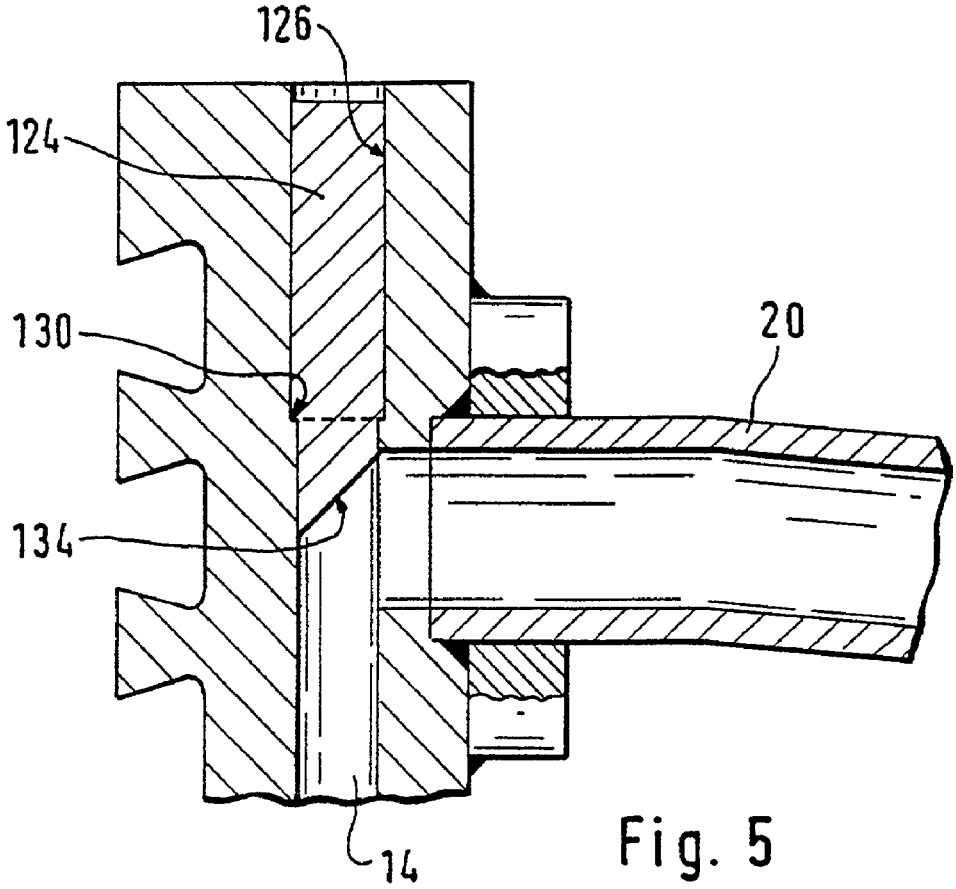
FIG. 5 a section through an alternative embodiment of a cooling plate according to the invention in the area of the transition between cooling duct and connection piece.

FIG. 1 shows a cooling plate 10 for a shaft furnace, in particular a blast furnace. Such cooling plates, also known as "staves", are arranged on the inside of the furnace shell and connected to the furnace cooling system. The back 11 of the cooling plate 10 shown in FIG. 1 is opposite the furnace shell.

The cooling plate 10 shown consists essentially of a cooling plate body 12 made from copper or a copper alloy with a rectangular surface. Four straight cooling ducts 14, which extend parallel with the surface through the cooling plate body 12 from one end 16 to the opposite end 18 are integrated in the cooling plate body 12. This cooling plate body 12 was advantageously manufactured by the method described in the subsequently published patent application WO 98/30345. A preform of the cooling plate body 12 was continuously cast in a continuous casting mould, whereby rod-type inserts in the casting duct produced ducts running in the casting direction, which form the cooling ducts 14. As shown in FIG. 2 the cross-section of the integrally cast ducts 14 has an oblong shape with its smallest dimension at right angles to the plate. A plate was cut out of this continuously cast preform by two cuts at right angles to the casting direction, the two end faces 16 and 18 of the cooling plate body 12 being formed. Grooves 19 running at right angles to the longitudinal direction of the plate were subsequently cut into one of the two surfaces of the cooling plate body 12 (see FIG. 2). This surface with the cut grooves 24 forms the front side 25 of the cooling plate body 12, which faces the furnace interior. After assembly of the cooling plate 10 in the blast furnace, the front side 25 of the cooling plate body 12 can be provided with a refractory material, the grooves 19 ensuring better adhesion of the refractory material.

On the back of the cooling plate 10 each cooling duct 14 has a connection piece 20 or 22 at each end. These connection pieces 20, 22 are essentially at right angles to the surface of the cooling plate body 12. They are led through the furnace shell to the outside of the furnace, where they are connected to the connection pieces of an adjacent cooling plate, so that the cooling plate 10 is incorporated in the cooling circuit of the furnace shell. The connection pieces 20 serve, for example, as feed connections and the connection pieces 22 as return connections of the cooling plate 10.

The connection according to the invention of connection pieces 20, 22 to the cooling ducts 14 in the cooling plate body 12 is described in more detail with the aid of FIGS. 2 to 4. FIG. 3 shows a transition piece 24, which is used for this connection according to the invention. It is advantageously a copper or copper alloy mould casting. As the thermal conductivity of the material used for manufacture of the transition piece 24 is not significant, a copper alloy suitable for mould casting, for example, and with higher mechanical strength than the copper alloy of the cooling plate body can be selected. The latter should in fact be characterised mainly by good thermal conductivity. The one-piece transition piece consists of a prismatic base 26 with two rounded edges 28, 30 and a cylindrical shoulder 32. The connection piece 22 is welded, soldered or screwed into a hole in the shoulder 32 or cast at the same time and projects at right angles from the free surface 33 of this shoulder 32. The inside diameter of this hole corresponds essentially to the outside diameter of the connection piece 22. A curved transition duct 34 is internally cast in the mould casting 24. This duct forms an opening 36 into the connection piece 22 in the shoulder 32, the opening having essentially the same circular free cross-section as the connection piece 22. A second opening 38 in the transition duct 26 is arranged in a lateral area 40 of the prismatic base 26. This second opening 38 has essentially the same oblong cross-section as the cooling ducts 14 in the cooling plate body. The integrally cast transition duct 34 is designed in such a way that the transition from the oblong to the circular cross-section takes place progressively, i.e. without significant discontinuities, which would produce local vortices and thus pressure losses in the flowing cooling medium.

As shown in FIGS. 1, 2 and 4, a mould casting 24 is inserted with its base 26 in a suitable recess in the copper cooling plate body 12 at each end of a cooling duct 14. These recesses are advantageously cut from the rear into the copper cooling plate body, the rounded corners 28 and 30 on the base 26 substantially simplifying this work. As shown in FIG. 4, each of the recesses terminates laterally in the respective end 16, 18 of the cooling plate body 12, the depth of the recesses being smaller than the thickness of the cooling plate body 12, so that the front of the cooling plate body 12 with its cut grooves 19 remains intact (see also FIG. 4). The second opening 38 of the transition duct 34 in the mould casting 24 is exactly opposite the opening of the cooling duct 14 into this recess. The remaining gap between the cooling plate body and the base 26 inserted in the recess is welded or soldered all round the surface, so that no cooling medium can escape through this gap. FIGS. 2 and 4 show that this seam has a relatively simple course, so that it can also easily be applied mechanically.

As shown in FIGS. 2 and 4, the shoulders 32 project from the cooling plate body 12 as pressing elements, which press a seal into the connection piece bushing in the furnace shell when the cooling plate is assembled.

As already mentioned above, the curved transition duct 34 integrally cast in the mould casting 24 forms a transition substantially more favourable from the flow point of view from the connection piece 20, 22 to the cooling duct 14 than a pipe connection piece welded or soldered directly into a hole in the cooling plate body. The pressure losses in the cooling plate 10 are thus substantially reduced, which, of course, has a favourable effect on the energy consumption for circulation of the cooling medium. Furthermore the risk of steam bubble formation due to high local pressure losses at the transition from cooling duct to connection piece is greatly reduced. The cooling plate 10 according to the invention likewise has the advantage that the transition from the connection piece 20, 22 to the cooling duct 14 is always effected identically by a standardised casting 24, so that the pressure losses in the individual cooling circuits can be predetermined and coordinated far more easily. The solution according to the invention is, of course, likewise preferable also from the mechanical point of view to direct welding or soldering of a connection piece into a hole in the cooling plate body. The solid shoulder into which the connection piece 20, 22 is inserted, makes a significant contribution in this respect.

Finally, it should be noted that the cooling plate body of a cooling plate according to the invention could also be manufactured by the method with blind holes described in DE-A-2907511. However, production by continuous casting as described above is far simpler and therefore also preferable. Furthermore, the cross-section of the integrally cast ducts may have an oblong shape with its smallest dimension at right angles to the cooling plate. Consequently the continuously cast cooling plates can be manufactured with a smaller plate thickness than cooling plates with drilled ducts, with the result that copper is saved and the useful volume of the furnace is increased. The present invention advantageously reduces the higher pressure losses which occur with transition to the connection piece 20, 22 with a circular free cross-section.

Figure 6:
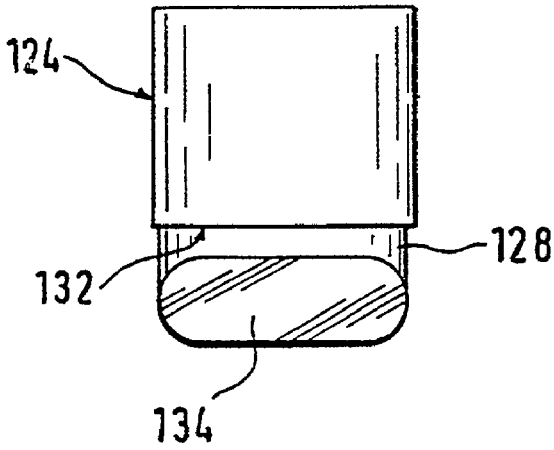
FIG. 6 a view of a formed piece for the embodiment of the transition between cooling duct and connection piece as shown in FIG. 5.

A simplified embodiment according to the invention of the transition region between the connection piece 20 and the cooling duct 14 is shown in FIG. 5. The connection piece is inserted directly in the cooling plate body 12 and welded to the latter. A formed piece 124, which is inserted in a recess 126 of the cooling plate body 12 in an axial extension of the cooling duct 14, forms a deflection surface 134 for the cooling medium in the area of the opening of the connection piece 20 into the cooling duct 14. As shown in FIG. 6, the formed piece 124, for example, is a plug, which is inserted in the end opening of the cooling duct 14 and extends to the opening of the connection piece 20 into the cooling duct 14. The deflection surface 134 for the cooling medium is formed by the front surface of its end 128 bevelled to 45°. As shown in FIG. 5, the cross-section of the duct 14 above the opening of the connection piece 20 is slightly larger than the cross-section of the actual cooling duct 14. This forms a shoulder area 130 in the duct 14, on which a corresponding shoulder area 132 of the plug 124 rests, so that the deflection surface 134 is positioned exactly below the opening of the connection piece 20 into the cooling duct 14.

In FIGS. 5 and 6 the cooling duct 14 and plug 124 have an oblong cross-section. However, both could, of course, have a circular cross-section.

The invention claimed is:

1. A cooling plate for an iron- and steelmaking furnace comprising:

a copper cooling plate body with at least one cooling duct for a cooling medium, which extends essentially parallel with the back of said cooling plate body, and at least one preformed, externally accessible recess into which said cooling duct opens;

at least one connection piece for a cooling medium connection on the back of said cooling plate body; and a formed piece that is fitted in said preformed, externally accessible recess in said cooling plate body so as to form a deflection surface for the cooling medium flowing from said connection piece into said cooling duct or from said cooling duct into said connection piece, wherein said formed piece is a prefabricated transition piece, which has an internal, curved transition duct forming said deflection surface.

2. The cooling plate according to claim 1, wherein in that said transition piece and said recess have complementary shapes, said transition piece being sealed from said outside in said recess.

3. The cooling plate according to claim 2, wherein a gap subsisting between said cooling plate body and said transition piece fitted in said recess is sealed from the outside by welding or soldering.

4. The cooling plate according to claim 3, wherein said cooling duct in said cooling plate body has an oblong cross-section and said connection piece has a circular cross-section, said transition from said oblong to said circular cross-section taking place progressively in said transition duct of said transition piece.

5. The cooling plate according to claim 1, wherein said cooling duct in said cooling plate body has a first cross-section and said connection piece a second cross-section, a transition from said first to said second cross-section taking place progressively in said transition duct of said transition piece.

6. The cooling plate according to claim 1 wherein said transition piece has a shoulder, which projects from said back of said cooling plate.

7. The cooling plate according to claim 1, wherein said connection piece is welded or soldered into said transition piece.

8. The cooling plate according to claim 1, wherein:

said cooling plate body has a front side, a rear side and a thickness; and said recess is milled into said copper cooling plate body from said rear side, so that it has a depth that is smaller than the thickness of said cooling plate body.

9. The cooling plate according to claim 1, wherein:

said cooling plate body has an end face; and said recess terminates in said end face.

10. The cooling plate according to claim 1, wherein said prefabricated transition piece is a mould casting made from copper or a copper alloy.

11. The cooling plate according to claim 1, wherein said at least one cooling duct is a blind bore drilled into said cooling plate body.

12. The cooling plate according to claim 1, wherein said cooling plate body is a continuously cast cooling plate, wherein said at least one cooling duct is formed as a continuous duct during continuous casting.

13. A process of manufacturing a cooling plate for an iron- and steelmaking furnace comprising following steps:

manufacturing a cooling plate body from copper or a copper alloy with at least one cooling duct for a cooling medium, which extends essentially parallel with the back of said cooling plate body, and at least one externally accessible recess into which said cooling duct opens;

providing at least one connection piece for a cooling medium connection on the back of said cooling plate body; and fitting a formed piece in said preformed, externally accessible recess in said cooling plate body so as to form a deflection surface for the cooling medium flowing from said connection piece into said cooling duct or from said cooling duct into said connection piece, wherein said formed piece is a prefabricated transition piece, which has an internal, curved transition duct forming said deflection surface.

14. The process according to claim 13, wherein in that said transition piece and said recess have complementary shapes, said transition piece being sealed from said outside in said recess.

15. The process according to claim 14, wherein a gap subsisting between said cooling plate body and said transition piece fitted in said recess is sealed from the outside by welding or soldering.

16. The process according to claim 13, wherein said cooling duct in said cooling plate body has a first cross-section and said connection piece a second cross-section, a transition from said first to said second cross-section taking place progressively in said transition duct of said transition piece.

17. The process according to claim 16, wherein said cooling duct in said cooling plate body has an oblong cross-section and said connection piece has a circular cross-section, said transition from said oblong to said circular cross-section taking place progressively in said transition duct of said transition piece.

18. The process according to claim 13 wherein said transition piece has a shoulder, which projects from said back of said cooling plate.

19. The process according to claim 13, wherein said connection piece is welded or soldered into said transition piece.

20. The process according to claim 13, wherein:

said cooling plate body has a front side, a rear side and a thickness; and said recess is milled into said copper cooling plate body from said rear side, so that it has a depth that is smaller than the thickness of said cooling plate body.

21. The process according to claim 13, wherein:

said cooling plate body has an end face; and said recess terminates in said end face.

22. The process according to claim 13, wherein said prefabricated transition piece is a mould casting made from copper or a copper alloy.

23. The process according to claim 13, wherein said at least one cooling duct is a blind bore drilled into said cooling plate body.

24. The process according to claim 13, wherein said cooling plate body is continuously cast, and said at least one cooling duct is formed as a continuous duct during continuous casting.

* * * * *